US007614113B2

(12) United States Patent
Roney et al.

(10) Patent No.: US 7,614,113 B2
(45) Date of Patent: Nov. 10, 2009

(54) MOTOR ENCLOSURE FOR A VACUUM CLEANER

(75) Inventors: Jeffrey T. Roney, Stanford, KY (US); Ronald E. Davis, Danville, KY (US)

(73) Assignee: Panasonic Corporation of North America, Secaucus, NJ (US)

( * ) Notice: Subject to any disclaimer, the term of this patent is extended or adjusted under 35 U.S.C. 154(b) by 834 days.

(21) Appl. No.: 10/903,561

(22) Filed: Jul. 30, 2004

(65) Prior Publication Data

US 2005/0022337 A1 Feb. 3, 2005

Related U.S. Application Data

(60) Provisional application No. 60/491,400, filed on Jul. 31, 2003.

(51) Int. Cl.
*A47L 9/22* (2006.01)

(52) U.S. Cl. ..... 15/412; 15/327.2; 15/327.7

(58) Field of Classification Search ..... 15/326, 15/412, 327.2, 327.7; 55/478, 481, 467, 55/DIG. 3; 417/423.9
See application file for complete search history.

(56) References Cited

U.S. PATENT DOCUMENTS

| | | | | |
|---|---|---|---|---|
| 2,335,428 | A * | 11/1943 | Lofgren | 55/467 |
| 2,542,634 | A | 2/1951 | Davis et al. | |
| 2,726,689 | A | 12/1955 | Busby | |
| 3,422,482 | A * | 1/1969 | Hamrick | 55/481 |
| 3,599,273 | A * | 8/1971 | Shirayanagi et al. | 15/326 |
| 3,626,669 | A * | 12/1971 | Cardiff | 55/481 |
| 3,875,436 | A | 4/1975 | MacFarland | |
| 4,330,899 | A | 5/1982 | Miller et al. | |
| 4,592,764 | A * | 6/1986 | Ikezaki et al. | 15/327.2 |
| D294,879 | S | 3/1988 | Berfield et al. | |
| 4,730,134 | A | 3/1988 | Sistare | |
| 4,733,429 | A * | 3/1988 | Jacob et al. | 15/326 |
| D315,235 | S | 3/1991 | Berfield et al. | |
| 5,016,316 | A | 5/1991 | McAllise et al. | |
| 5,287,029 | A | 2/1994 | Krouse | |
| 5,445,545 | A | 8/1995 | Draper | |
| 5,714,815 | A | 2/1998 | Fritzinger et al. | |
| 5,765,258 | A | 6/1998 | Melito et al. | |
| 5,803,940 | A * | 9/1998 | Rick et al. | 55/467 |
| 5,974,623 | A | 11/1999 | Cummins et al. | |
| 5,991,969 | A * | 11/1999 | Lee | 15/326 |
| 6,070,289 | A * | 6/2000 | Lee et al. | 15/326 |
| 6,195,835 | B1 * | 3/2001 | Song et al. | 55/DIG. 3 |
| 6,375,720 | B2 * | 4/2002 | Embree et al. | 95/273 |
| 6,913,635 | B2 * | 7/2005 | Yoo et al. | 55/DIG. 3 |
| 7,143,469 | B2 * | 12/2006 | Moine et al. | 55/DIG. 3 |
| 2002/0007735 | A1 * | 1/2002 | Volo et al. | 55/481 |
| 2003/0217432 | A1 * | 11/2003 | Oh et al. | 15/327.2 |

* cited by examiner

*Primary Examiner*—Dung Van Nguyen
(74) *Attorney, Agent, or Firm*—King & Schickli, PLLC

(57) ABSTRACT

A motor enclosure for a vacuum cleaner includes a body having both a motor receiver for receiving a motor and a filter receiver for receiving a filter.

24 Claims, 5 Drawing Sheets

MOTOR ENCLOSURE FOR A VACUUM CLEANER

This application claims the benefit of U.S. Provisional Patent Application Ser. No. 60/491,400 filed on Jul. 31, 2003.

TECHNICAL FIELD

The present invention relates generally to the floor care equipment field and, more particularly, to a novel motor enclosure for a vacuum cleaner and a vacuum cleaner incorporating such an enclosure.

BACKGROUND OF THE INVENTION

A vacuum cleaner is an electro-mechanical appliance utilized to effect the dry removal of dust, dirt and other small debris from carpets, rugs, fabrics or other surfaces in both domestic and industrial environments. In order to achieve the desired dirt and dust removal, most vacuum cleaners incorporate a rotary agitator. The rotary agitator is provided to beat dirt and dust from the nap of the carpet or rug while a pressure drop or vacuum is used to force air entrained with this dirt and dust into the nozzle of the vacuum cleaner. The particulate laden air is then drawn through a bag-like filter, a removable dirt cup or a cyclonic separation chamber and filter combination which traps the dirt and dust while the substantially clean air is exhausted by an electrically operated fan that is driven by an onboard motor. It is this fan and motor arrangement that generates the drop in air pressure necessary to provide the desired cleaning action. Thus, the fan and motor arrangement is commonly known as the vacuum or suction generator.

The present invention relates to a motor enclosure for the suction generator of a vacuum cleaner. The motor enclosure is relatively simple in design, inexpensive to produce, easy to mount in the housing of a vacuum cleaner, and provides effective and efficient sealing for enhanced cleaning efficiency.

SUMMARY OF THE INVENTION

In accordance with the purposes of the present invention as described herein, a motor enclosure is provided for a vacuum cleaner including both a motor and filter. The motor enclosure comprises a body including both a motor receiver and a filter receiver. The body also includes a first conduit and a second conduit. The first and second conduits each have a first end in fluid communication with the motor receiver and a second end in fluid communication with the filter receiver.

More specifically describing the invention, the body includes a first section and a second section that are secured together. The first section includes the motor receiver and the second section includes the filter receiver. A first fastening feature is provided on the first section and a second, cooperating fastening feature is provided on the second section. It is the first section that includes the first and second conduits. Further, the first fastening feature is provided on the first and second conduits. In accordance with one possible embodiment of the present invention, the first and second fastening features are cooperating tabs and apertures.

The second section includes first and second filter receiver inlets. The first and second filter receiver inlets communicate with the first and second conduits. Additionally, the filter receiver includes a filter support. A filter is provided in the filter receiver abutting the filter support. An inlet manifold is formed between the filter and the first and second filter receiver inlets.

The motor enclosure also includes a filter adapter for holding an alternative type of filter. The filter adapter includes a frame engaging the filter support and a filter cavity for holding that filter of alternative design.

The second section of the body also includes a removable cover allowing access to the filter in the filter receiver. An outlet manifold is formed between the filter and the cover. Further, an exhaust outlet is provided in the second section in fluid communication with the outlet manifold. Air exiting the motor enclosure through the exhaust outlet may be directed through a vent to the environment or conveyed by a passage so as to flow over selected electronics and/or a cord reel to provide cooling prior to exhausting to the environment.

Still more specifically describing the invention, the first section of the body includes a closed end adjacent the second section and an opened end opposite the closed end. A first motor support engages the open end of the first section. The first motor support is annular and constructed from a vibration damping material such as low durometer rubber.

In accordance with yet another aspect of the present invention, the motor enclosure includes a second motor support that engages the closed end of the first section. The second motor support is also constructed from a vibration damping material such as low durometer rubber. The closed end of the first section includes a mounting aperture and the second motor support includes a projection received in that mounting aperture. Additionally, the second motor support includes at least one protuberance.

The motor enclosure also includes a fan and motor assembly in the motor receiver. The fan and motor assembly includes a housing. The first motor support engages a first end of that housing and the second motor support engages a second end of that housing. The housing includes at least one mounting hole and the at least one protuberance in the second motor support is received in that mounting hole.

The projection on the second motor support includes a hub opening. The fan and motor assembly includes a hub that is received in this opening when the fan and motor assembly is properly seated in the motor enclosure. In addition, the closed end of the first section of the body includes a first pair of spaced slots. The second motor support includes a second pair of spaced slots. Together, the first and second pair of slots define a pair of electrical conductor inlets for electrical conductors that provide power to the contacts of the motor of the fan and motor assembly. The electrical conductor inlets are provided at opposite sides of the fan and motor assembly.

In accordance with yet another aspect of the present invention, a vacuum cleaner is provided incorporating the motor enclosure.

In the following description there is shown and described a preferred embodiment of this invention, simply by way of illustration of one of the modes best suited to carry out the invention. As it will be realized, the invention is capable of other different embodiments and its several details are capable of modification in various, obvious aspects all without departing from the invention. Accordingly, the drawings and descriptions will be regarded as illustrative in nature and not as restrictive.

BRIEF DESCRIPTION OF THE DRAWING

The accompanying drawing incorporated in and forming a part of this specification, illustrates several aspects of the present invention, and together with the description serves to explain certain principles of the invention. In the drawing.

Figure 1:
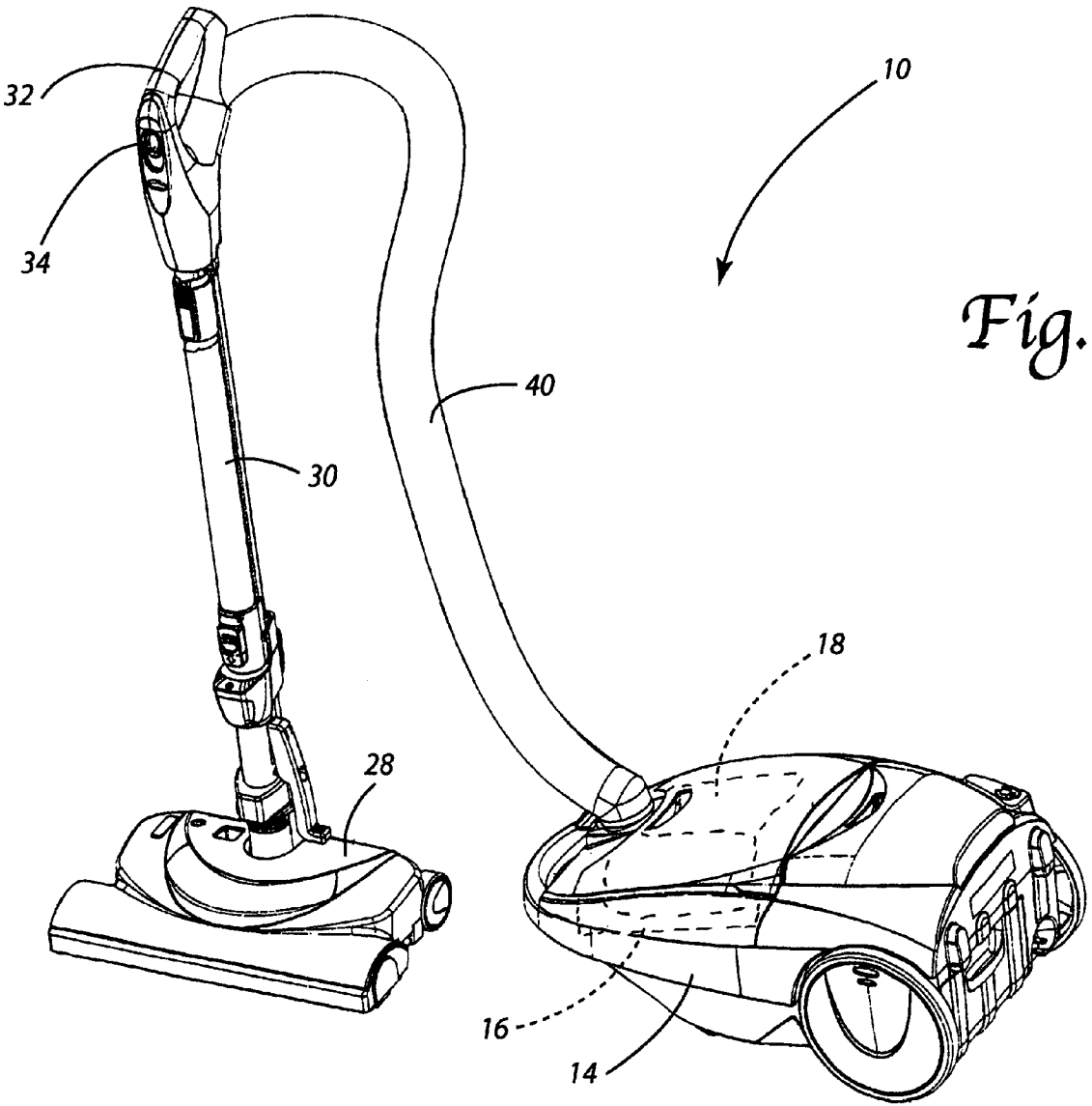
FIG. 1 is a perspective view of a canister vacuum cleaner incorporating the motor enclosure of the present invention.

Reference will now be made in detail to the present preferred embodiment of the invention, an example of which is illustrated in the accompanying drawing.

DETAILED DESCRIPTION OF THE INVENTION

Reference is now made to FIGS. 1-3 and 6 illustrating a canister vacuum cleaner 10 incorporating the motor enclosure 12 of the present invention. As illustrated, the canister vacuum cleaner 10 includes a canister housing 14 that includes a cavity 16 for receiving a filter bag 18 used to collect dirt and debris in a manner known in the art. The canister housing 14 also includes a compartment 20 that receives the motor enclosure 12. A fan and motor assembly 24, including a housing 26 is held in the motor enclosure 12 in a manner described in greater detail below.

The canister vacuum cleaner 10 also includes a powerhead or nozzle 28 equipped with a rotary agitator (not shown). The power nozzle 28 is connected to a wand 30 including a control handle 32 incorporating an actuator 34 for turning the vacuum cleaner on and off. A cord reel 38 takes up and pays out an electrical cord (not shown) which is connected to an electrical wall outlet to provide power to the vacuum cleaner. A hose.40 connects the wand 30 to the filter bag 18 in the canister housing 14.

Reference is now made to FIGS. 2-4, 5*a*, 5*b* and 6 which fully and completely illustrate the motor enclosure 12 of the present invention. The motor enclosure 12 includes a body having a first section 42 and a second section 44. The first body section 42 includes a sidewall 46, an opened end 48 and a closed end 50 that define a motor receiver or cavity 52. A first conduit 54 and a second conduit 56 are also formed in the first body section 42. As should be appreciated, the first and second conduits 54, 56 are in fluid communication with the motor receiver 52.

The second body section 44 includes an end wall 58 and a series of sidewalls 60 that function together to define a filter receiver 62. First and second filter receiver inlets 64, 66 are carried by the second body section 44 and are provided in fluid communication with the filter receiver 62.

As should be appreciated from reviewing the drawing figures, the first body section 42 and second body section 44 are secured together so that the first conduit 54 is connected to and in fluid communication with the first filter receiver inlet 64 and the second conduit 56 is connected to and in fluid communication with the second filter receiver inlet 66. Cooperating fastening features such as projecting tabs 68 provided on the first and second conduits 54, 56 and apertures 70 provided on the first and second filter receiver inlets 64, 66 secure the first and second body sections 42, 44 together.

The fan and motor assembly 24 is mounted in the motor receiver 52 of the first body section 42 by means of a first motor support 72 and a second motor support 74. Both motor supports 72, 74 are constructed from vibration damping material such as low durometer rubber. Thus, the motor supports 72, 74 function to dampen vibration and also seal the fan and motor assembly 24 in the motor receiver 52.

The first motor support 72 is annular and is stretched slightly to fit snugly over a first end 76 of the housing 26 of the fan and motor assembly 24. The second motor support 74 includes two protuberances 78 and two projecting flanges 80 that are specifically oriented to engage the second end 82 of the housing 26 of the fan and motor assembly 24. More specifically, the protuberances 78 engage in cooperating apertures (not shown) in the housing end 82 while the flanges 80 simultaneously engage the sides of the housing 26 adjacent the end 82.

As should be further appreciated, the second motor support 74 includes a projection 84 having a hub receiving aperture 86. A hub 88 of the fan and motor assembly 24 is received in the aperture 86. Together, the hub receiving aperture 86, flanges 80 and protuberances 78 ensure that the second motor support 74 fits snugly and securely on the second end 82 of the housing 26.

The fan and motor assembly 24 is securely held in the motor receiver 52 by means of the first and second motor supports 72, 74. More specifically, the projection 84 has a unique irregular shape adapted to specifically fit in a cooperating mounting aperture 90 in the closed end 50 of the first body section 42. Simultaneously, the first motor support 72 is compressed slightly to fit snugly in the opened end 48 of the sidewall 46 of the first body section 42. Thus, it should be appreciated that the first and second motor supports 72, 74 function to dampen the vibrations of the motor of the fan and motor assembly 26, secure the fan and motor assembly in the motor receiver 52 of the first body section 42 and seal both ends of the motor assembly. Accordingly, the only air path into the motor receiver 52 is through the inlet 92 of the fan and motor assembly and the only exit is through the first and second conduits 54, 56. A wrapping of foam rubber 53 may be provided around the fan and motor assembly 24 in order to reduce operating noise while allowing substantially unimpeded airflow.

Figure 5B:
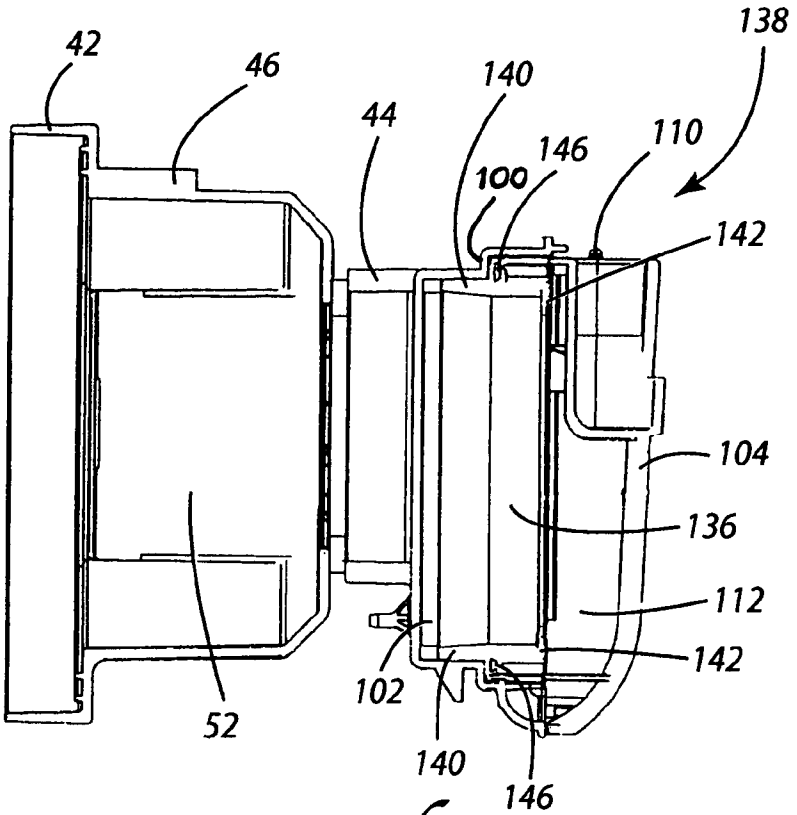
FIG. 5*b* is a detailed, schematic view showing the adapter holding a second type of true HEPA filter in the filter receiver.
Figure 5A:
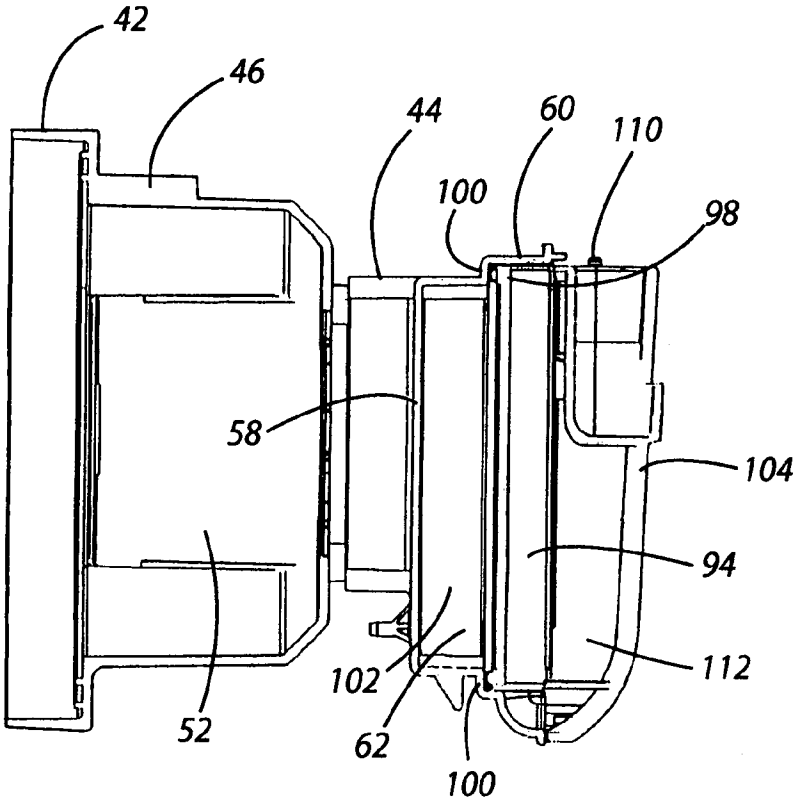
FIG. 5*a* is a detailed, schematic view showing the mounting of a first type of filter cartridge in the filter receiver.

A filter cartridge 94 is secured in the filter receiver 62 of the second body section 44. More specifically, the filter cartridge 94 includes a pleated filter material 96 held in a support frame 98 (see FIG. 4). More specifically, the sidewalls 60 of the second body section 44 are stepped and include a series of shoulders that form a filter support 100. As illustrated in FIG. 5*a*, when properly seated in the filter receiver 62, the frame 98 of the filter cartridge 94 rests on the filter support 100 and an inlet manifold 102 is formed between the end wall 58 and the filter cartridge 94.

The filter receiver 62 is closed by a cover 104 that may be secured in place on the sidewalls 60. More specifically, cover 104 may include lugs (not shown) received in cooperating notches (not shown) on one of the sidewalls 60 and resilient locking tabs 110 that engage the opposite sidewall or the canister assembly housing 14 and thereby hold the cover securely in position. When properly seated, the cover 104 forms an outlet manifold 112 between the filter cartridge 94 and the cover 104. An exhaust outlet 114 is also provided in the second body section 44 in fluid communication with the outlet manifold 112.

Figure 2:
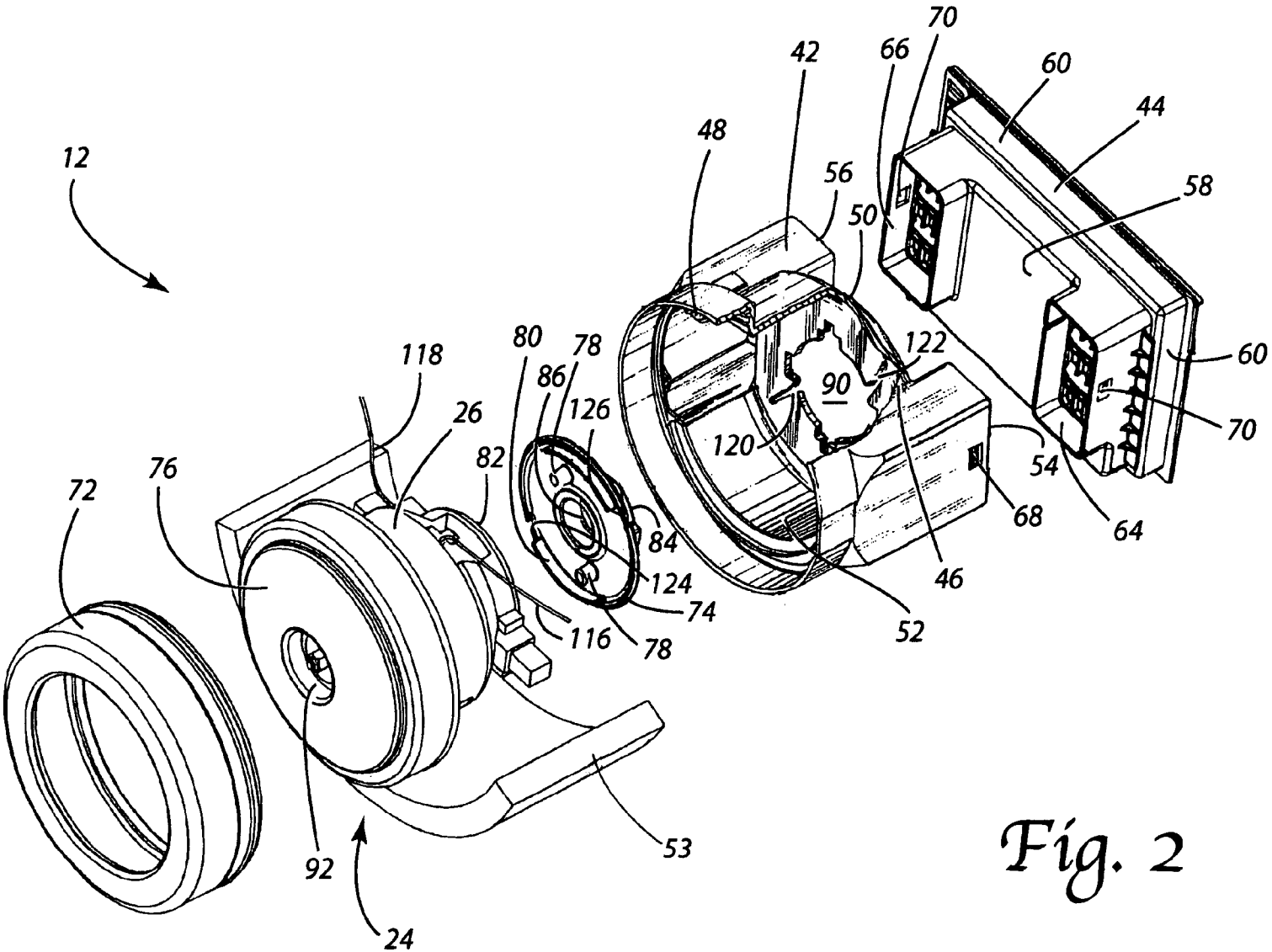
FIG. 2 is an exploded perspective view of the motor enclosure of the present invention.
Figure 4:
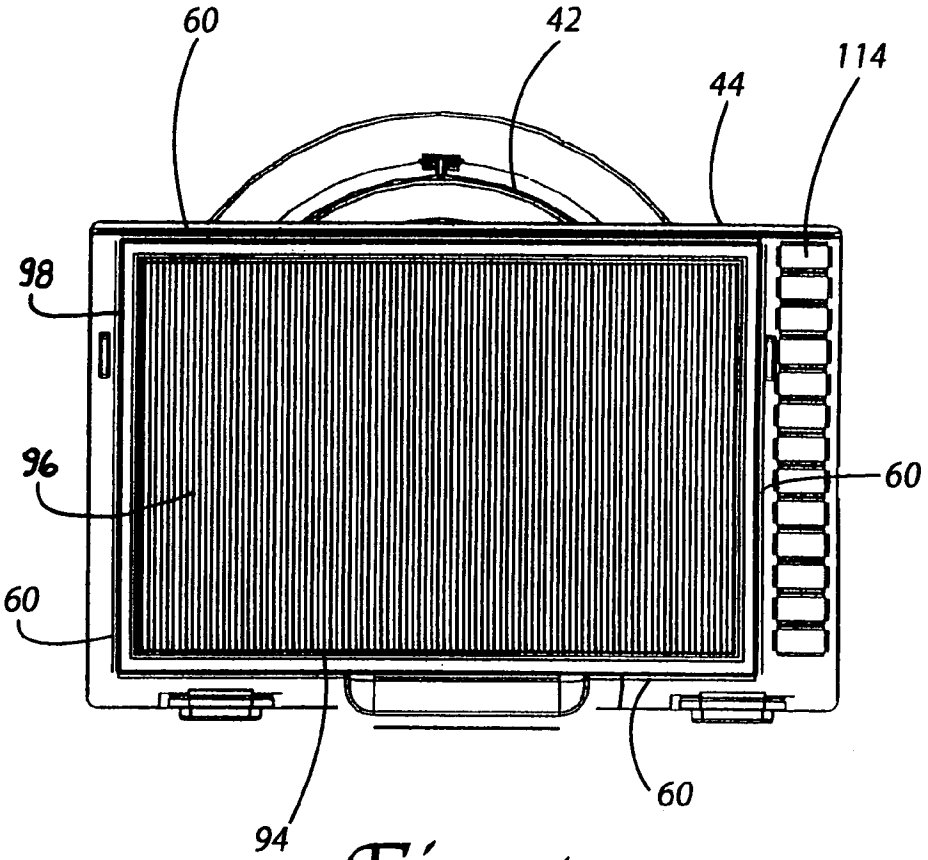
FIG. 4 is an end elevational view of the second section of the body of the motor enclosure with the cover removed to show the filter receiver.
Figure 3:
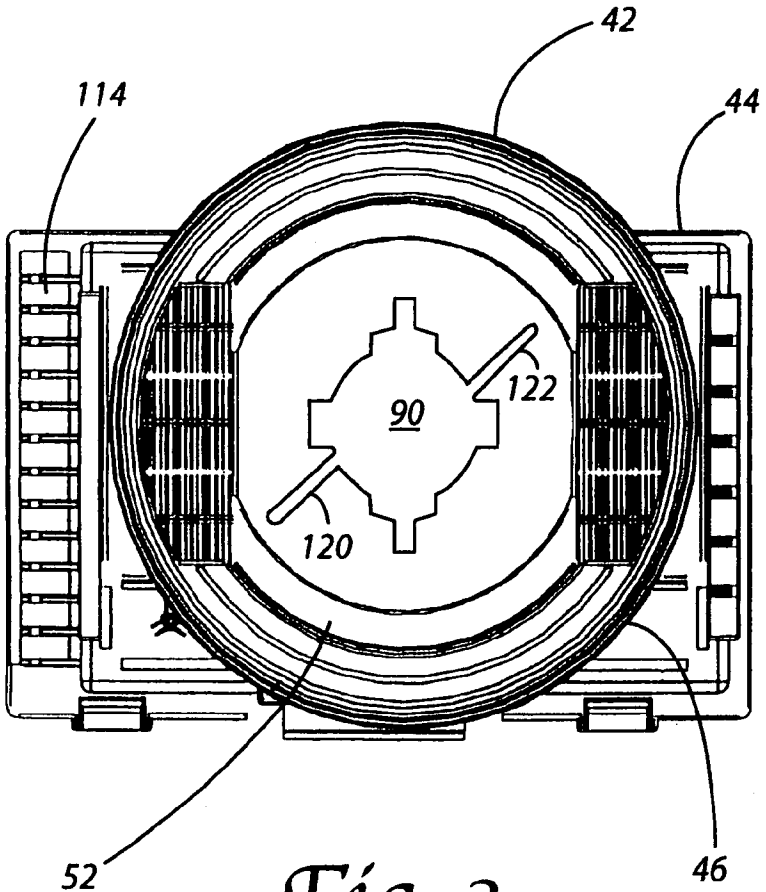
FIG. 3 is an end elevational view of the opened end of the first section of the body of the motor enclosure.

The motor of the fan and motor assembly 24 is powered by electricity through insulated leads or electrical conductors 116, 118. As illustrated in FIGS. 2 and 3, the closed end 50 of the first body section 42 includes a pair of spaced slots 120, 122. Similarly, the second motor support 74 includes a second pair of spaced slots 124, 126. The slots 120, 122 in the first body section 42 and the slots 124, 126 in the second motor support 74 are opposed or spaced 180° apart with respect to the hub 88 of the fan and motor assembly 24. Together, the slots 120 and 124 define a first opening for receiving the first electrical conductor 116 while the slots 122 and 126 form a second opening for receiving the second electrical conductor 118. The resiliency of the second motor support 74 ensures that a tight seal is made around the conductors 116, 118 to prevent any air leaks that might adversely affect vacuum cleaner performance.

Figure 6:
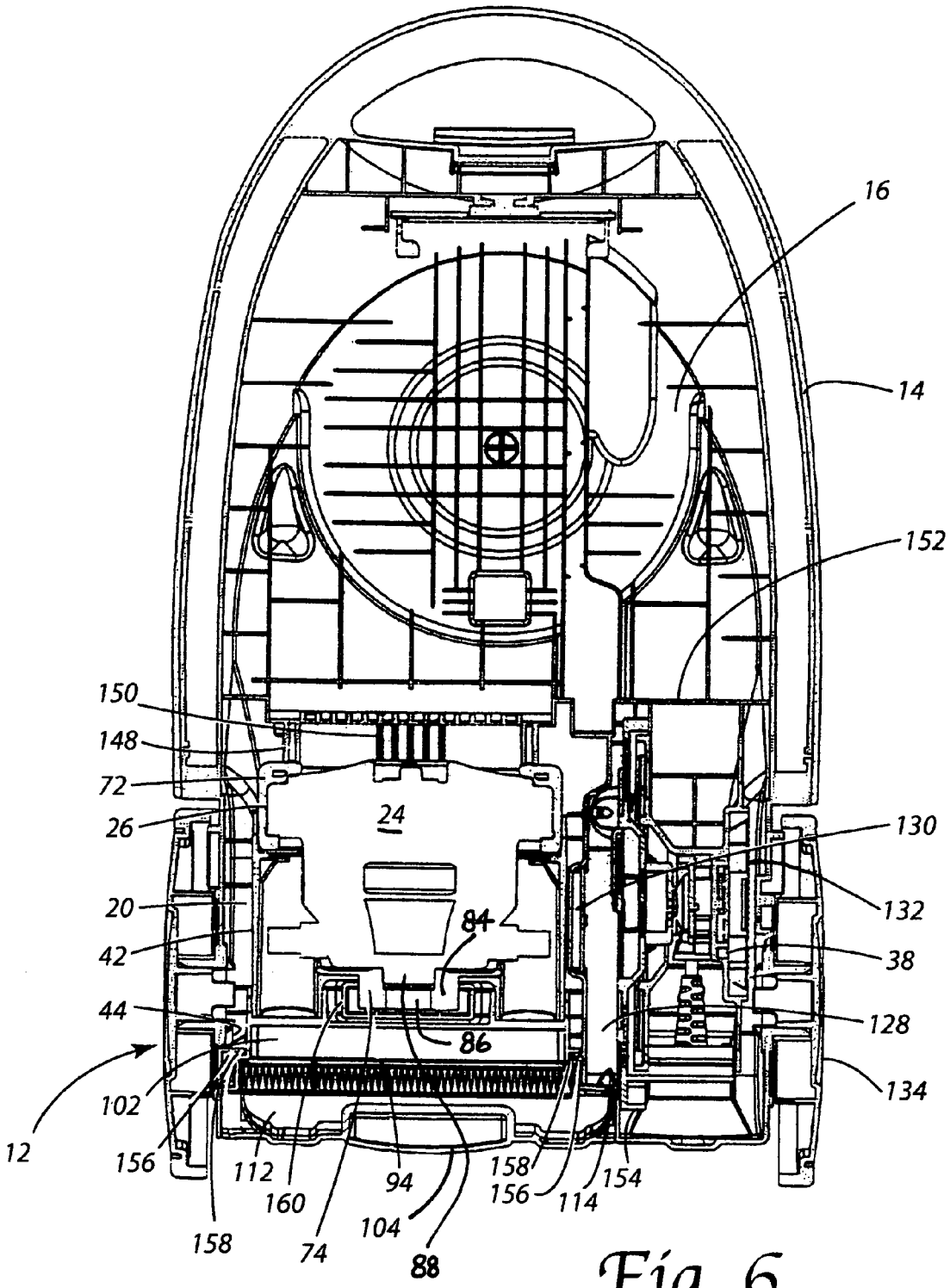
FIG. 6 is a top plan view illustrating a motor enclosure mounted in the housing of the canister assembly with the top of the canister assembly removed for clarity of illustration.

Reference is now made to FIG. 6 illustrating how the motor enclosure 12 of the present invention is mounted in the canister housing 14 of the vacuum cleaner 10. Advantageously, the motor enclosure 12 simply slides into place thereby providing ease of fabrication. More specifically, the first motor support 72 is compressed against the wall 148 defining the port 150 in the bulkhead 152 dividing the bag cavity 16 from the motor compartment 20. The second body section 44 of the motor enclosure 12 engages the rear wall 154 of the canister housing 14. Flanges 156 on the canister housing 14 are also captured in channels 158 formed on the second body section 44. In addition, a cradle 160 on the canister housing 14 receives and holds the end of the second motor support 74 projecting from the first body section 42.

The operation of the vacuum cleaner 10 will now be described in detail. The operator energizes the motor of the fan and motor assembly 24 by manipulating the actuator 34. The motor for driving the actuator in the power nozzle 28 is simultaneously energized so as to rotate that agitator relative to the floor. Cleaning structures such as beater bars, wipers, brushes or bristle tufts on the rotary agitator function to brush and beat dirt and debris from the nap of an underlying carpet being cleaned. That dirt and debris is drawn by the suction airstream generated by the fan and motor assembly 24 from the power nozzle 28 through the wand 30 and hose 40 into the filter bag 18. Dirt and debris is trapped in the filter bag 18 while clean air is drawn from the filter bag into the compartment 20 holding the motor enclosure 12. The now clean airstream is then drawn into the inlet 92 of the fan and motor assembly 24. That clean air then passes over the motor of the fan and motor assembly 24 to provide cooling before exiting the motor receiver 52 through the first and second conduits 54, 56.

The first and second conduits 54, 56 are in fluid communication with the first and second filter receiver inlets 64, 66 through which the air enters the inlet manifold 102. The air is then forced through the filter cartridge 94 where the pleated filter material 96 removes any remaining contaminants including any carbon from the motor brushes. The now fully cleaned and processed airstream flows through the outlet manifold 112 and the exhaust outlet 114 thereby exiting the filter receiver 62. The air is then directed along the passageway 128 over an electronic circuit board 130 and then through the cord reel 38 so as to provide cooling. The airstream is then exhausted through the vent 132 adjacent one of the wheels 134 on the canister housing 14.

Numerous benefits result from employing the concepts of the present invention. First, it should be appreciated that the motor enclosure 12 is a simple structure that is very inexpensive to produce. Further, the motor enclosure 12 provides excellent sealing and relatively turbulence-free airflow so as to substantially enhance vacuum cleaner performance.

The foregoing description of the preferred embodiment of this invention has been presented for purposes of illustration and description. It is not intended to be exhaustive or to limit the invention to the precise form disclosed. Obvious modifications or variations are possible in light of the above teachings. For example, as best illustrated in FIG. 5*b*, the filter receiver 62 also holds a true HEPA filter 136 even though that filter is a different size and shape than the filter cartridge 94. More specifically, an adapter 138 includes a series of sidewalls 140.

Inwardly projecting flanges 142 at one end of the sidewalls 140 cooperate with the sidewalls to form a cavity for receiving a HEPA filter 136. An outwardly projecting lip 146 on the sidewalls 140 provides a shoulder for mounting the adapter 138 and the HEPA filter contained in the cavity therein on the filter support 100 in the filter receiver 62. Accordingly, it should be appreciated that the filter receiver 62 is particularly versatile and capable of receiving more than one type of filter.

Of course, other modifications are also possible. For example, while the canister vacuum cleaner illustrated is equipped with a filter bag 18, a dirt cup with or without cyclonic air flow features could be substituted therefor. Additionally, while the motor enclosure 12 is illustrated as being mounted in a canister vacuum cleaner 10, it could just as easily be mounted in an upright vacuum cleaner or a handheld vacuum cleaner if desired.

The embodiment was chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled. The drawings and preferred embodiment do not and are not intended to limit the ordinary meaning of the claims and their fair and broad interpretation in any way.

What is claimed is:

1. A motor enclosure for a vacuum cleaner including both a motor and a filter, said motor enclosure comprising:

a body enclosing said motor and including both a motor receiver and a filter receiver, said body further including a first conduit and a second conduit, said first and second conduits each having a first end in fluid communication with said motor receiver and a second end in fluid communication with said filter receiver;

said body including first and second sections that are secured together, wherein said first section includes said motor receiver and said second section includes said filter receiver, said first section further including said first and second conduits, and wherein a first fastening feature is provided on said first and second conduits and a second, cooperating fastening feature is provided on said second section, said first and second fastening features comprising cooperating tabs and apertures.

2. The motor enclosure of claim 1, wherein said second section includes first and second filter receiver inlets, said first and second filter receiver inlets communicating with said first and second conduits.

3. The motor enclosure of claim 2, wherein said filter receiver includes a filter support.

4. The motor enclosure of claim 3, further including a filter in said filter receiver and an inlet manifold between said filter and said first and second filter receiver inlets.

5. The motor enclosure of claim 4, wherein said second section includes a removable cover allowing access to said filter receiver.

6. The motor enclosure of claim 5, further including an outlet manifold between said filter and said cover.

7. The motor enclosure of claim 6, further including an exhaust outlet in said second section in fluid communication with said outlet manifold.

8. The motor enclosure of claim 3, further including a filter adapter having a frame engaging said filter support and a filter cavity for holding a filter.

9. The motor enclosure of claim 2, wherein said first section includes a closed end adjacent said second section and an open end opposite said closed end.

10. The motor enclosure of claim 9, further including a first motor support engaging said open end of said first section.

11. The motor enclosure of claim 10, wherein said first motor support is annular and constructed from vibration damping material.

12. The motor enclosure of claim 11, further including a second motor support engaging said closed end of said first section.

13. The motor enclosure of claim 12, wherein said second motor support is constructed from vibration damping material.

14. The motor enclosure of claim 13, wherein said closed end includes a mounting aperture and said second motor support includes a projection received in said mounting aperture.

15. The motor enclosure of claim 14, wherein said second motor support includes at least one protuberance.

16. The motor enclosure of claim 15, further including a fan and motor assembly in said motor receiver.

17. The motor enclosure of claim 16, wherein said fan and motor assembly includes a housing.

18. The motor enclosure of claim 17, wherein said first motor support engages a first end of said housing and a second motor support engages a second end of said housing.

19. The motor enclosure of claim 18, wherein said housing includes at least one mounting hole and said at least one protuberance is received in said mounting hole.

20. The motor enclosure of claim 19, wherein said projection includes a hub opening and said fan and motor assembly includes a hub received in said opening.

21. The motor enclosure of claim 20, wherein said closed end includes a first pair of spaced slots and said second motor support includes a second pair of spaced slots, said first and second pair of slots defining a pair of electrical conductor inlets.

22. The motor enclosure of claim 21, wherein said pair of electrical conductor inlets are provided at opposite sides of said fan and motor assembly.

23. The motor enclosure of claim 12, wherein said first and second motor supports are constructed from low durometer rubber.

24. A vacuum cleaner incorporating the motor enclosure of claim 1.

* * * * *